US006549747B2

(12) United States Patent
Brown et al.

(10) Patent No.: US 6,549,747 B2
(45) Date of Patent: Apr. 15, 2003

(54) CONDUCTIVE FUR BRUSH CLEANER HAVING AN INSULATED CASING

(75) Inventors: Kenneth J. Brown, Rochester, NY (US); Joseph A. Kwiatkowski, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/080,005

(22) Filed: Feb. 21, 2002

(65) Prior Publication Data

US 2003/0044205 A1 Mar. 6, 2003

Related U.S. Application Data

(60) Provisional application No. 60/317,394, filed on Sep. 5, 2001.

(51) Int. Cl.[7] ..... G03G 21/00

(52) U.S. Cl. ..... 399/353; 399/123; 399/354

(58) Field of Search ..... 15/1.51, 256.5, 15/256.51, 256.52; 399/123, 353, 354, 356, 358

(56) References Cited

U.S. PATENT DOCUMENTS 3,917,397 A * 11/1975 Tanaka et al. ..... 399/353
3,965,524 A * 6/1976 Kurita et al. ..... 399/353
5,937,254 A * 8/1999 Maher et al. ..... 399/297

* cited by examiner

*Primary Examiner*—Hoang Ngo

(57) ABSTRACT

A method and structure for a conductive fur brush cleaner assembly for an image processing apparatus is disclosed. The cleaner assembly includes a plurality of rotating components, an insulated outer cover surrounding the rotating components and a conductive inner cover surrounding the rotating components. The insulated outer cover prevents a charge from being bled from the conductive inner cover. The conductive inner cover accumulates a charge from the waste particles within the cleaner assembly such that the inner cover becomes biased.

33 Claims, 5 Drawing Sheets

CONDUCTIVE FUR BRUSH CLEANER HAVING AN INSULATED CASING

This application claims the benefit of Provisional application Ser. No. 60/317,394, filed Sep. 5, 2001.

BACKGROUND OF THE INVENTION

1. Field of the Invention

The present invention relates in general to a cleaning assembly for an electrostatographic marking engine, and more particularly to a cleaning assembly which includes a casing that is insulated to decrease the amount of contamination on the cleaner casing.

2. Description of the Related Art

In a typical commercial reproduction apparatus (electrostatographic copier/duplicators, printers, or the like), a latent image charge pattern is formed on a uniformly charged dielectric member. Pigmented marking particles are attracted to the latent image charge pattern to develop such images on the dielectric member. A receiver member is then brought into contact with the dielectric member. An electric field, such as is provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There, the image is fixed to the receiver member by heat and/or pressure from the fuser apparatus to form a permanent reproduction thereon.

However, not all of the marking particles are transferred to the printing material and some remain upon the belts or drum. Therefore, a cleaning assembly is commonly used to remove the excess marking particles. The cleaning assembly usually includes an electrostatic cleaning brush (detone roller), a skive, and a receptacle to hold the excess marking particles (waste toner material). The devices within the cleaner assembly generally rotate to remove waste particles.

However, a problem occurs when charged airborne toner collects on the electrically grounded conductive casing of the cleaner. This causes contamination of the casing that effectively reduces the overall reliability of the cleaning subsystem. This problem is solved by the invention described below which physically insulates the cover (casing) of the cleaner.

SUMMARY OF THE INVENTION

In view of the foregoing and other problems, disadvantages, and drawbacks of the conventional cleaner assembly, the present invention has been devised, and it is an object of the present invention, to provide a structure and method for an improved cleaner assembly.

In order to attain the object suggested above, there is provided, according to one aspect of the invention, a conductive fur brush cleaner assembly for an image processing apparatus. The cleaner assembly includes a plurality of rotating components, an insulated outer cover surrounding the rotating components and a conductive inner cover surrounding the rotating components. The conductive inner cover accumulates a charge from the waste particles within the cleaner assembly such that the inner cover becomes biased. The conductive inner cover is biased to have the same charge as the waste particles within the cleaner assembly such that the conductive inner cover repels the waste particles. The rotating components include an electrostatic brush for removing the waste particles from an intermediate transfer member. The rotating components include a detoning roller adapted to remove the waste particles from the electrostatic brush. The invention also includes a skive for removing the waste particles from the detoning roller. Further, the invention includes an auger adapted to move the waste particles removed from the detoning roller to a waste receptacle.

The electrical insulation of the cleaner cover allows a net charge to build up on the electrical insulation and prevents charge from the airborne toner from being bled to the cleaner cover. This net charge that builds up on the electrical insulation is of a polarity such that it will repel any additional toner of the same polarity.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF PREFERRED EMBODIMENTS OF THE INVENTION

Figure 1A:
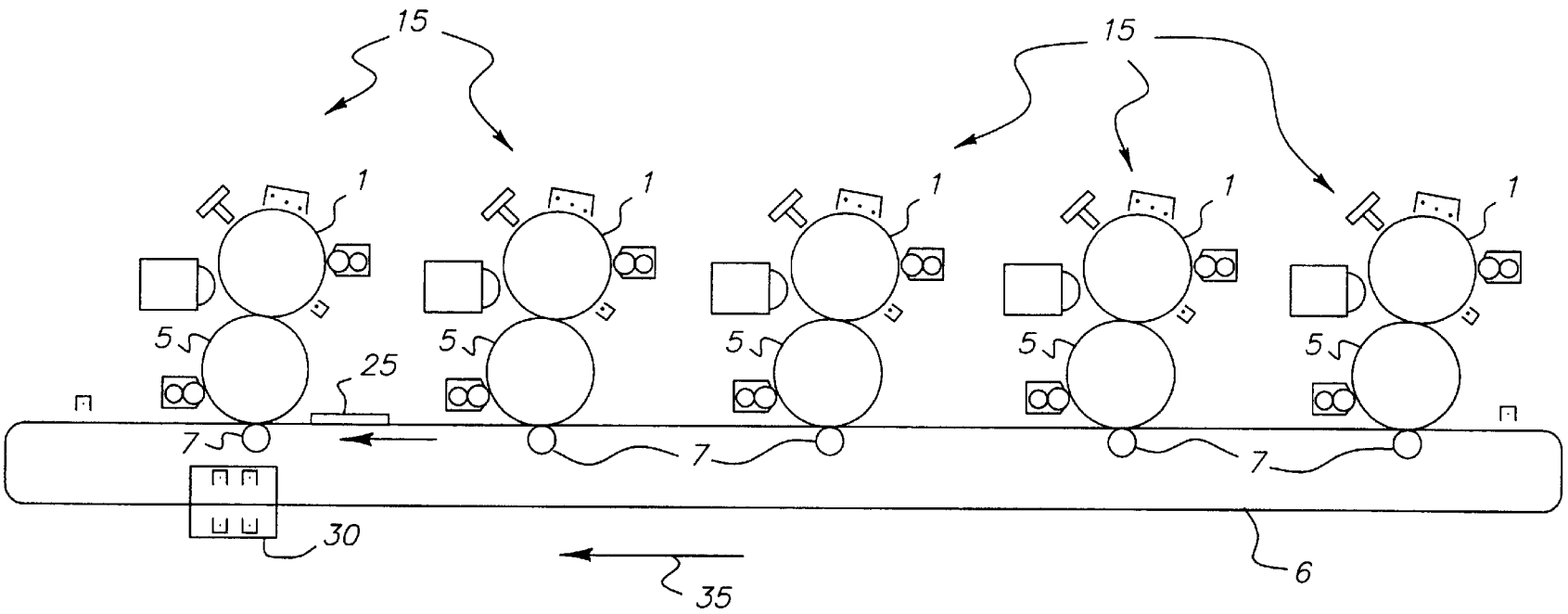
FIGS. 1A and 1B are side elevation schematics of a image processing apparatus utilizing a cleaning apparatus of the invention.
Figure 1B:
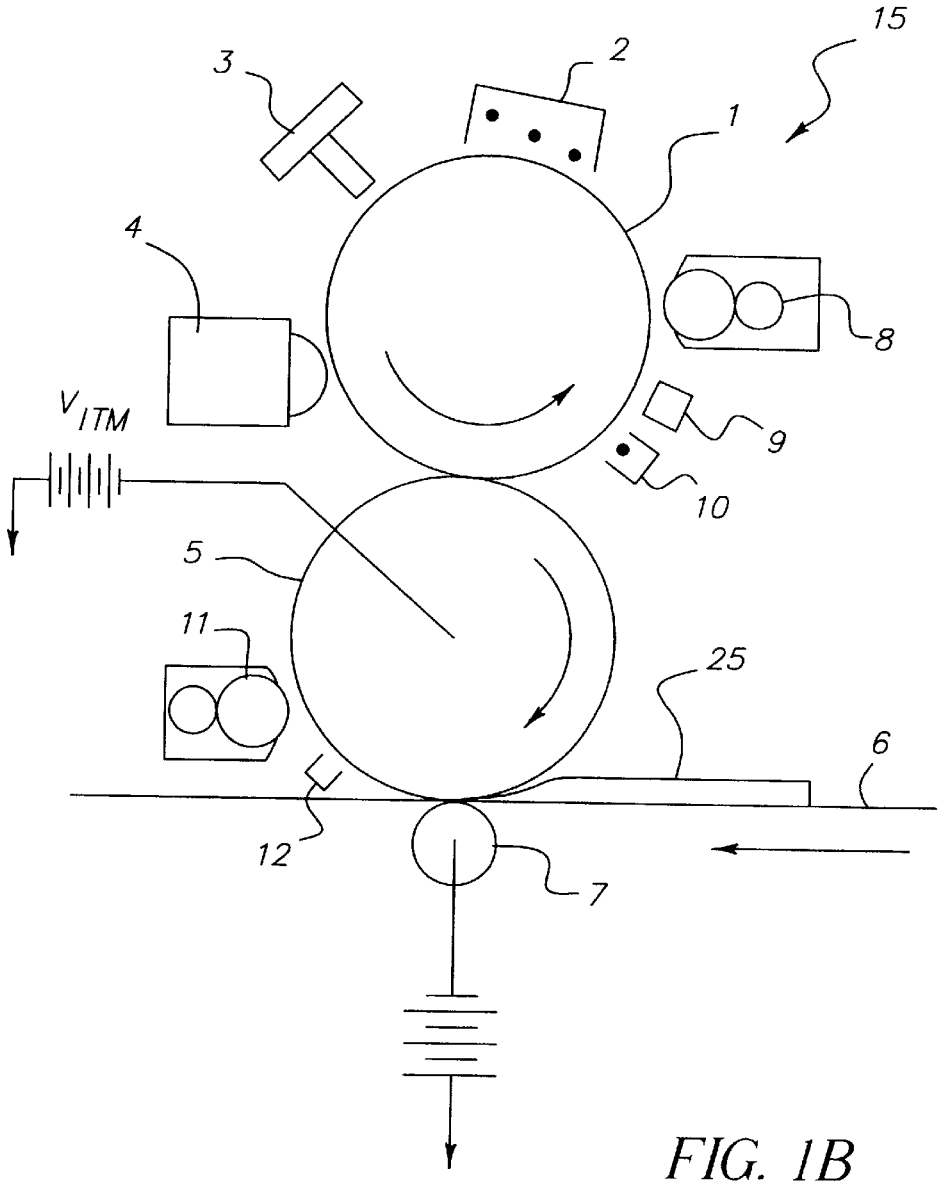

FIG. 1A illustrates an apparatus in which the invention may be used. A conveyor 6 is drivable to move a receiving sheet 25 (e.g., paper, plastic, etc.) past a series of stations 15. One of the stations 15 is shown in greater detail in FIG. 1B.

With the invention, a primary image member (for example a photoconductive drum) 1 within each imaging station 15 is initially charged by a primary charging station 2. This charge is then modified by a printhead 3 (e.g., LED printhead) to create an electrostatic image on the primary image member 1. A development station 4 deposits toner on the primary image member 1 to form a toner image corresponding to the color of toner in each individual imaging station 15. The toner image is electrostatically transferred from the primary image member 1 to an intermediate transfer member, for example, intermediate transfer roller or drum 5. While both of the primary image member 1 and the image transfer drum 5 are shown as drums, as would be known by one ordinarily skilled in the art, these could also comprise belts or similar image transfer surfaces. The primary image member 1 and the image transfer drum 5 are used in these examples to simplify the explanation of the invention; however, the invention is not limited to drums, but instead, is applicable to all similar structures/surfaces.

Figure 2:
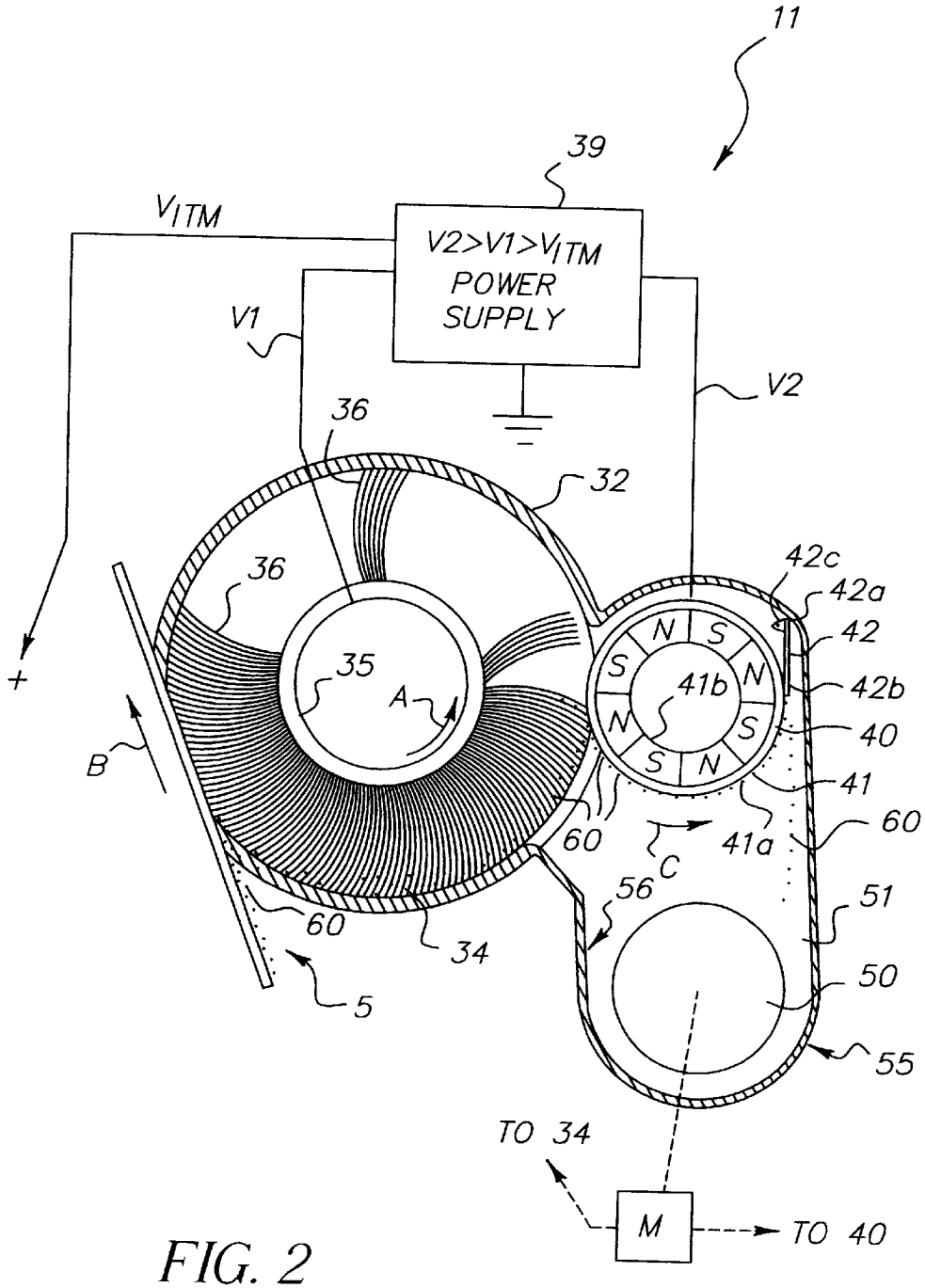
FIG. 2 is a side elevation schematic showing in greater detail the cleaning apparatus forming a part of the apparatus of FIG. 1.

After the charged toner is transferred to the intermediate transfer drum 5, there still remains some waste toner particles that need to be removed from the primary image member 1. The invention uses a pre-cleaning erase light emitting diode (LED) lamp 9 in combination with pre-cleaning charging station 10 in order to electrostatically modify the surface potential of the non-image areas of the primary image member 1 and the charge on the waste toner remaining on the primary image member 1, respectively. In addition, a cleaning station 8 is included to physically remove any remaining waste toner particles. The cleaning station 8 is illustrated in FIG. 2 and is discussed in greater detail below.

A transfer nip is used between a transfer backer roller 7 and the intermediate transfer drum 5 to transfer the toner image to the receiving sheet 25. In a similar manner to that discussed above, the remaining waste toner particles that remain on the intermediate transfer drum 5 after the toner has been transferred to the sheet 25 are removed using a pre-cleaning charging station 12 and a cleaning station 11. Once again, the details of the cleaning station 11 are shown in FIG. 2 and are discussed below in detail. The receiving sheet 25 is transported by a dielectric conveyor 6 to a fuser 30 where the toner image is fixed by conventional means. The receiving sheet is then conveyed from the fuser 30 to an output tray 35.

The toner image is transferred from the primary image member 1 to the intermediate transfer drum 5 in response to an electric field applied between the core of drum 5 and a conductive electrode forming a part of primary image member 1. The toner image is transferred to the receiving sheet 25 at the nip in response to an electric field created between the backing roller 7 and the transfer drum 5. Thus, transfer drum 5 helps establish both electric fields. As is known in the art, a polyurethane roller containing an appropriate amount of anti-static material to make it of at least intermediate electrical conductivity can be used for establishing both fields. Typically, the polyurethane or other elastomer is a relatively thick layer; e.g., one-quarter inch thick, which has been formed on an aluminum base.

Preferably, the electrode buried in the primary image member 1 is grounded for convenience in cooperating with the other stations in forming the electrostatic and toner images. If the toner is a positively-charged toner, an electrical bias $V_{ITM}$ applied to intermediate transfer drum 5 of typically −300 to −1,500 volts will effect substantial transfer of toner images to transfer drum 2. To then transfer the toner image onto a receiving sheet 25, a bias, e.g., of −2,000 volts or greater negative voltages, is applied to backing roller 7 to again urge the positively-charged toner to transfer to the receiving sheet. Schemes are also known in the art for changing the bias on drum 5 between the two transfer locations so that roller 7 need not be at such a high potential.

The ITM or drum 5 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5*10^7$ Newtons per square meter to facilitate release of the toner to ordinary paper or another type of receiving sheet. The base layer is preferably compliant and has a Young's modulus of $10^7$ Newtons per square meter or less to assure good compliance for each transfer.

With reference also now to FIG. 2, the cleaning apparatus 11 comprises a housing 32 which encloses the cleaning brush 34 having conductive fibers 36 which, through an opening in the housing, engage the ITM 2.

The brush 34 is supported on a core 35 which is driven in rotation by a motor M or other motive source to rotate in the direction of the arrow A as the ITM is moved in the direction shown by arrow B. As the brush rotates, untransferred toner particles 60 and other particulate debris, such as carrier particles and paper dust on the ITM 2, are mechanically scrubbed from the ITM and picked up into the fibers 36 of the brush. The items illustrated in the figures are generally not shown to scale to facilitate understanding of the structure and operation of the apparatus. In particular, the brush fibers are shown much larger to scale than other structures shown in FIG. 2.

In addition to mechanical scrubbing, an electrical bias is applied to the cleaning brush from power supply 39. The electrical bias V1 of the power supply 39 to the cleaning brush is, as will be more fully explained below, inductively, and not conductively, coupled to the conductive fibers or brush fibers 36. The voltage V1 is greater than the voltage bias $V_{ITM}$ applied to the ITM. The polarity of the voltage on the brush fibers electrostatically attract toner 60 to the brush fibers. The toner particles 60 entrained within the fibers are carried to a rotating detoning roller 40 which is electrically biased by power supply 39 to a higher voltage level V2 than the voltage level V1; i.e., the voltage level V2 is of a level to electrostatically attract the toner particles in the brush to the detoning roller. Assuming a positively charged toner image, as an example, the toner image may be attracted to the ITM which is biased to the voltage bias $V_{ITM}$ in the range of about −300 volts to about −1500 volts. The cleaning brush, in such an example would be biased to a potential V1 which is in the range of about −550 volts to about −1750 volts. The detoning roller in this example would be biased to a potential V2 which is in the range of about −800 volts to about −2000 volts. In considering relationships of voltage $V2>V1>V_{ITM}$, the absolute values of the voltages are implied.

The toner particles 60 are electrostatically attracted to the surface 41 of the detoning roller 40. The surface of detoning roller 40 is rotated in the direction of arrow C by a drive from motor M counter to that of the brush fibers or alternatively in the same direction. The toner particles are carried by the surface 41 of the detoning roller toward a stationary skive blade 42 which is supported as a cantilever at end 42*a* so that the scraping end 42*b* of the blade 42 engages the surface 41 of the detoning roller.

Toner particles scrubbed from the surface are allowed to fall into a collection chamber 51 of housing 32 and periodically a drive, such as from motor M or another motive source, is provided to cause an auger 50, or another toner transport device, to feed the toner to a waste receptacle. Alternatively, the collection receptacle may be provided, attached to housing 32, so that particles fall into the receptacle directly and the auger may be eliminated. In order to ensure intimate contact between the detoning roller surface 41 and the skive blade 42, a permanent magnet is stationarily supported within the hollow enclosure of the detoning roller.

The skive blade is made of a metal such as ferromagnetic steel and is of a thickness of less than 0.5 mm and is magnetically attracted by the magnet to the detoning roller surface 41. This effectively minimizes the tendency of the blade end 42*b* to chatter as the surface 41 travels past the blade end 42*b* and thus provides more reliable skiving of the toner and, therefore, provides improved image reproduction. The skive blade extends for the full working width of the detoning roller surface 41 and is supported at its end 42*b* by ears 42*c* which are soldered to the blade. A pin extends through a hole in the ear portion to connect the skive to the housing.

The detoning roller 40 preferably comprises a toning or development roller as is used in known SPD-type development stations which include a core of permanent magnets surrounded by a metal sleeve 41*a*. As a detoning roller, the magnetic core is formed of a series of alternately arranged poles (north-south-north-south, etc.), permanent magnets 41*b* that are stationary when in operation. Sleeve 41*a* is formed of polished aluminum or stainless steel and is electrically conductive, but nonmagnetic, so as to not reduce the magnetic attraction of the skive blade to the magnets in the core. The sleeve is driven in rotation in the direction of arrow C and is electrically connected to potential V2.

As shown above, in a conductive fiber brush cleaning system, electrostatic forces are used to entrain the waste toner in a fiber matrix of the conductive fiber (fur) brush 34 after the waste toner is released from the substrate 5 by mechanical action of the brush fiber against the waste toner particle. As is also shown above, this system employs a biased, magnetic core detone roller 40 to electrostatically attract (scavenge) the waste toner from the conductive fiber brush and collect it in a secondary container.

As discussed above, airborne toner can collect on the electrically grounded conductive casing of the cleaner. This causes external contamination that effectively reduces the overall reliability of the cleaning subsystem. When charged toner comes into proximity of the grounded casing, an electric field exists between the charged toner particle and the casing which can allow the charged toner particle to be attracted to the casing. A majority of the charge on the toner particle is then bled off to the casing, leaving the toner particle on the casing with some low net charge. Even though a large quantity of toner particles could be present on the casing, the net charge on the casing would be very low, since a majority of the toner charge bleeds off to the casing at contact.

In order to overcome the foregoing problem, the casing/cover 32 is formed of an insulating outside cover 55 and a conducting inside cover 56. For example, the insulating portion of the cover can comprise 0.003@ of a polyamide tape such as DuPont KAPTON® tape (DuPont High Performance Materials, P.O. Box 89, Route 23 South and DuPont Road, Circleville, Ohio 43113). The electrical insulation 55 of the cleaner cover 32 allows a net charge to build up on the electrical insulation 55 and prevents charge from the airborne toner from being bled to the cleaner cover 32. This net charge that builds up on the electrical insulation 55 is of a polarity such that it will repel any additional toner of the same polarity. This invention is especially applicable for cleaning systems that are designed to primarily clean positive or negative polarity toner, since the polarity of the toner that the cleaner cover would repel is dependent upon the polarity of the toner deposited upon it.

Figure 3:
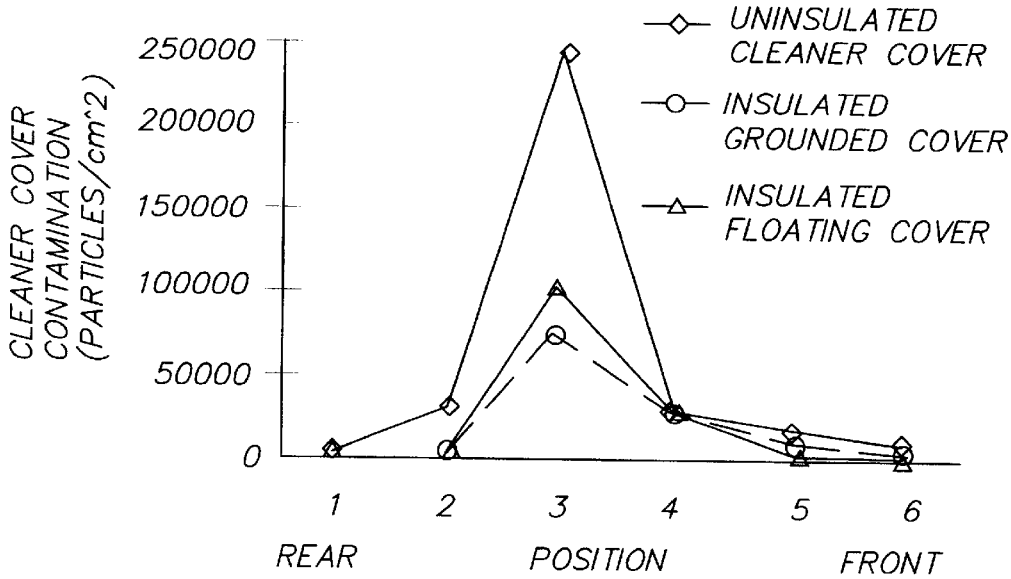
FIG. 3 is a graph depicting the effect of insulating the cover of the cleaner.
Figure 4:
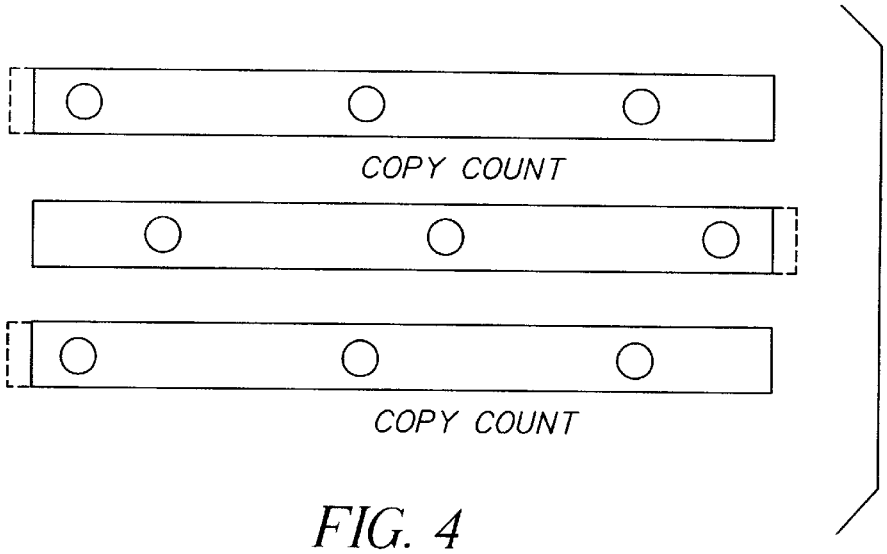
FIG. 4 is a diagram showing the results of operating with an image processing apparatus with an uninsulated cleaning cover.
Figure 5:
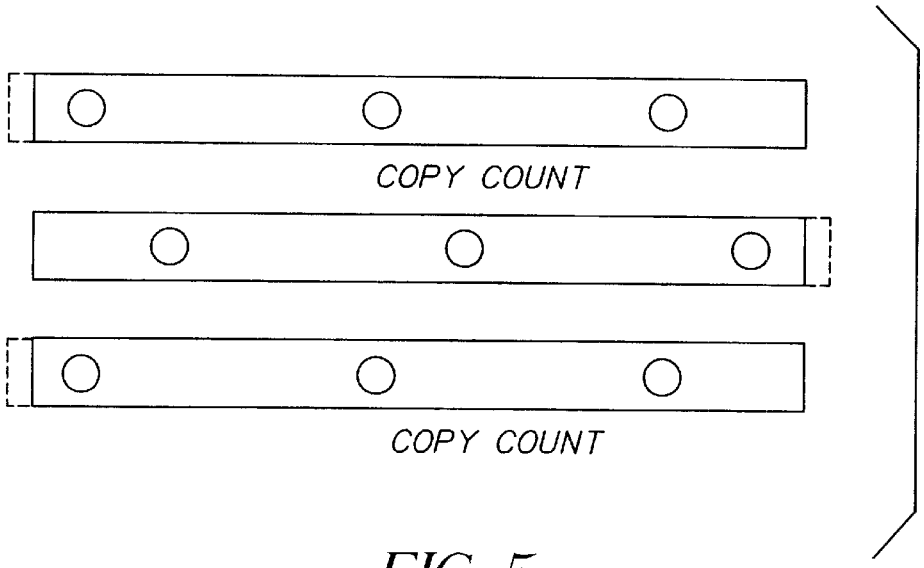
FIG. 5 is a diagram showing the results of operating with an image processing apparatus with an insulated grounded cleaning cover.
Figure 6:
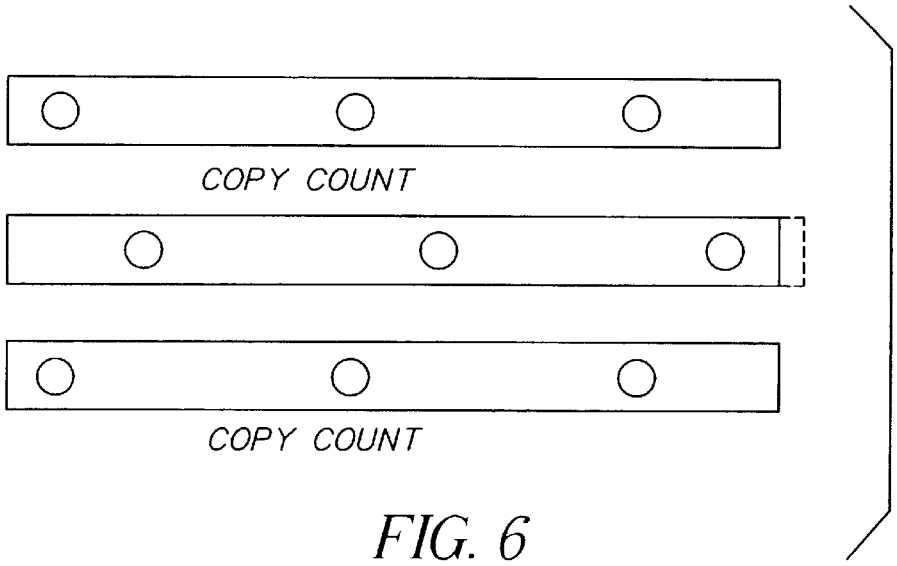
FIG. 6 is a diagram showing the results of operating with an image processing apparatus with an insulated floating cleaning cover.

FIGS. 3–6 show the improvement attained with the invention when compared to an uninsulated casing. More specifically, FIG. 3 shows the relationship between the external contamination of the cleaning station and the insulation of the cleaner cover. As can be seen in FIG. 3, the inventive insulated cleaner cover has substantially less contamination than the uninsulated cleaner cover. FIG. 4 illustrates the results of operating with an image processing apparatus with an uninsulated cleaning cover. FIG. 5 illustrates the results of operating with an image processing apparatus with an insulated grounded cleaning cover. FIG. 6 illustrates the results of operating with an image processing apparatus with an insulated floating cleaning cover. These data were collected by first running 250 copies of a standard image, and then removing the toner that was collected on the top cover of the cleaner by transferring it to a piece of transparent tape. This tape is then affixed to a paper substrate, and the toner particles are then counted by microscopy and associated image analysis software.

The electrical insulation of the cleaner cover allows a net charge to build up on the electrical insulation and prevents a charge from the airborne toner from being bled to the cleaner cover. This net charge that builds up on the electrical insulation is of a polarity such that it will repel any additional toner of the same polarity.

While the invention has been described in terms of preferred embodiments, those skilled in the art will recognize that the invention can be practiced with modification within the spirit and scope of the appended claims.

PARTS LIST

| Item | Description |
|---|---|
| 1 | image member |
| 2 | imaging charging station |
| 3 | printhead |
| 4 | development station |
| 5 | intermediate transfer drum |
| 6 | conveyor |
| 7 | transfer backer roller |
| 8 | cleaning station |
| 9 | LED lamp |
| 10 | pre-cleaning charging station |
| 11 | cleaning station |
| 12 | pre-cleaning charging station |
| 15 | station |
| 25 | receiving sheet |
| 30 | fuser |
| 32 | housing/cleaner cover |
| 34 | cleaning brush |
| 35 | output tray/core |
| 36 | fibers |
| 39 | power supply |
| 40 | detoning roller |
| 41 | roller surface |
| 41a | metal sleeve |
| 41b | permanent magnets |
| 42 | skive blade |
| 42a | blade end |
| 42b | scraping blade end |
| 42c | blade ears |
| 50 | auger |
| 51 | collection chamber |
| 55 | insulating outside cover |
| 56 | conducting inside cover |
| 60 | toner particles |
| 141 | detone roller |

What is claimed is:

1. A conductive fur brush cleaner assembly for an image processing apparatus, said cleaner assembly comprising:

a plurality of rotating components;

an insulated outer cover surrounding said rotating components; and a conductive inner cover surrounding said rotating components.

2. The cleaner assembly in claim 1, wherein said conductive inner cover accumulates a charge from waste particles within said cleaner assembly such that said inner cover becomes biased.

3. The cleaner assembly in claim 2, wherein said conductive inner cover is biased to have the same charge as waste particles within said cleaner assembly such that said conductive inner cover repels said waste particles.

4. The cleaner assembly in claim 2, wherein said rotating components include an electrostatic brush for removing said waste particles from an intermediate transfer member.

5. The cleaner assembly in claim 4, wherein said rotating components include a detoning roller adapted to remove said waste particles from said electrostatic brush.

6. The cleaner assembly in claim 5, further comprising a skive for removing said waste particles from said detoning roller.

7. The cleaner assembly in claim 6, further comprising an auger adapted to move said waste particles removed from said detoning roller to a waste receptacle.

8. A conductive fur brush cleaner assembly for an image processing apparatus, said cleaner assembly comprising:

a plurality of rotating components;

an insulated outer cover surrounding said rotating components; and a conductive inner cover surrounding said rotating components, wherein said insulated outer cover prevents charge from being bled from said conductive inner cover.

9. The cleaner assembly in claim 8, wherein said conductive inner cover accumulates a charge from waste particles within said cleaner assembly such that said inner cover becomes biased.

10. The cleaner assembly in claim 9, wherein said conductive inner cover is biased to have the same charge as said waste particles within said cleaner assembly such that said conductive inner cover repels said waste particles.

11. The cleaner assembly in claim 9, wherein said rotating components include an electrostatic brush for removing said waste particles from an intermediate transfer member.

12. The cleaner assembly in claim 11, wherein said rotating components include a detoning roller adapted to remove said waste particles from said electrostatic brush.

13. The cleaner assembly in claim 12, further comprising a skive for removing said waste particles from said detoning roller.

14. The cleaner assembly in claim 13, further comprising an auger adapted to move said waste particles removed from said detoning roller to a waste receptacle.

15. A conductive fur brush cleaner assembly for an image processing apparatus, said cleaner assembly comprising:

a plurality of rotating components;

an insulated outer cover surrounding said rotating components; and a conductive inner cover surrounding said rotating components, wherein said insulated outer cover prevents charge from being bled from said conductive inner cover, and wherein said conductive inner cover accumulates a charge from waste particles within said cleaner assembly such that said inner cover becomes biased.

16. The cleaner assembly in claim 15, wherein said conductive inner cover is biased to have the same charge as said waste particles within said cleaner assembly such that said conductive inner cover repels said waste particles.

17. The cleaner assembly in claim 15, wherein said rotating components include an electrostatic brush for removing said waste particles from an intermediate transfer member.

18. The cleaner assembly in claim 17, wherein said rotating components include a detoning roller adapted to remove said waste particles from said electrostatic brush.

19. The cleaner assembly in claim 18, further comprising a skive for removing said waste particles from said detoning roller.

20. The cleaner assembly in claim 19, further comprising an auger adapted to move said waste particles removed from said detoning roller to a waste receptacle.

21. A method of cleaning waste particles from an image processing apparatus, said method comprising:

providing a cleaning apparatus having a plurality of rotating components;

providing an insulated outer cover surrounding said rotating components; and attaching a conductive inner cover to said insulated outer cover.

22. The method in claim 21, wherein said conductive inner cover accumulates a charge from waste particles within said cleaner assembly such that said inner cover becomes biased.

23. The method in claim 22, wherein said conductive inner cover is biased to have the same charge as waste particles within said cleaner assembly such that said conductive inner cover repels said waste particles.

24. The method in claim 22, wherein said rotating components include an electrostatic brush for removing said waste particles from an intermediate transfer member.

25. The method in claim 24, wherein said rotating components include a detoning roller adapted to remove said waste particles from said electrostatic brush.

26. The method in claim 25, further comprising providing a skive for removing said waste particles from said detoning roller.

27. The method in claim 26, further comprising providing an auger adapted to move said waste particles removed from said detoning roller to a waste receptacle.

28. A method of cleaning waste particles from an image processing apparatus, said method comprising:

providing a cleaning apparatus having a plurality of rotating components;

providing an insulated outer cover surrounding said rotating components; and attaching a conductive inner cover to said insulated outer cover, wherein said conductive inner cover accumulates a charge from waste particles within said cleaner assembly such that said inner cover becomes biased.

29. The method in claim 28, wherein said conductive inner cover is biased to have the same charge as waste particles within said cleaner assembly such that said conductive inner cover repels said waste particles.

30. The method in claim 28, wherein said rotating components include an electrostatic brush for removing said waste particles from an intermediate transfer member.

31. The method in claim 30, wherein said rotating components include a detoning roller adapted to remove said waste particles from said electrostatic brush.

32. The method in claim 31, further comprising providing a skive for removing said waste particles from said detoning roller.

33. The method in claim 32, further comprising providing an auger adapted to move said waste particles removed from said detoning roller to a waste receptacle.

* * * * *